US005890234A

United States Patent [19]

Lan

[11] Patent Number: 5,890,234

[45] Date of Patent: Apr. 6, 1999

[54] ONE PIECE WATER DRAIN UNIT IN A DIVER MASK

[76] Inventor: Shun-Nan Lan, No. 3, Lane 183 Chung-Hsing Rd., Hsi-Chih Chen, Taipei Hsien, Taiwan

[21] Appl. No.: 137,321

[22] Filed: Aug. 20, 1998

[51] Int. Cl.[6] ..... A61F 9/02

[52] U.S. Cl. ..... 2/428; 128/201.28; 128/207.12

[58] Field of Search ..... 2/426, 428, 430, 2/429, 446; 128/200.29, 201.28, 207.12, 207.16, 205.24, 203.11; 220/203.29; 405/186, 192; 166/325; 137/516.11, 516.15, 516.17

[56] References Cited

U.S. PATENT DOCUMENTS

| | | | |
|---|---|---|---|
| 3,073,339 | 1/1963 | Stelzer | 137/516.15 |
| 4,077,068 | 3/1978 | Anderson | 2/428 |
| 4,957,106 | 9/1990 | Vandeputte | 128/201.19 |
| 5,231,982 | 8/1993 | Harrison et al. | 128/207.12 |
| 5,329,643 | 7/1994 | Sato | 128/206.21 |
| 5,558,446 | 9/1996 | Kuo et al. | 128/200.29 |
| 5,564,130 | 10/1996 | Feng | 2/428 |
| 5,572,989 | 11/1996 | Lutz et al. | 2/452 |
| 5,608,920 | 3/1997 | Oliver et al. | 2/428 |
| 5,638,552 | 6/1997 | Fujima | 2/443 |
| 5,642,529 | 7/1997 | Fujima | 128/200.29 |

FOREIGN PATENT DOCUMENTS

| | | | |
|---|---|---|---|
| 638598 | 2/1964 | Belgium | 128/207.12 |
| 1033036 | 3/1956 | Germany | 2/428 |

*Primary Examiner*—John J. Calvert
*Assistant Examiner*—Tejash D Patel
*Attorney, Agent, or Firm*—Jacobson, Price, Holman & Stern, PLLC

[57] ABSTRACT

A water drain groove in a diver mask, the diver mask involving a mirror-frame shaped face mask, inside the mask is a soft-toned inside flange, at the middle of the lower half of the inside flange is a nose part, at the bottom side of the nose part is a hole, to the hole is joined a water drain unit, characterized in that: the rim of the water drain unit is buried in the hole of the nose part, the water drain unit has a connecting frame part, the connecting frame part protrude outward, at the bottom side of the nose part is the formation of a outward extended ring part which serves to guide the water and prevent water from flowing in, spaced at the middle of a ring-shaped connecting frame part are a number of through holes, so designed that the hole at the bottom side of the soft-toned nose part joins with the connecting frame part as one unit, at the middle of the water drain unit is a fixing hole, the fixing hole is joined by a number of connecting strips to the connecting frame part, into the outside of each connecting strip is pressed a membrane, the center of the membrane is fixed to the fixing hole, so the membrane covers the communicating hole between the ring part of the nose part and the water drain unit.

1 Claim, 5 Drawing Sheets

ONE PIECE WATER DRAIN UNIT IN A DIVER MASK

BACKGROUND OF THE INVENTION

This invention relates to a "structural improvement of water drain groove in a diver mask", particularly to one involving direct connection between a water drain groove and a diver mask, to facilitate assembling and involve a check function.

Conventionally, a prior art of soft-toned nose-protruding diver mask equipped with a water drain mechanism involves, as illustrated in FIGS. 4 and 5, a mirror-frame with an inside flange, the mirror being mounted to the inside flange of the mirror frame; a soft-toned lining frame with a framework, the soft-toned lining frame is mounted in the inside flange of the mirror frame; a nose part 32 that is composed of a nose bottom part 321, a nose bridge part 323 and a nose wing; an inside flange that is fixed in the mirror frame, matched with said mirror frame, a frame edge and mirror edge that tightens said soft-toned lining frame with said inside flange; a water drain structure, at the nose bottom part 321 of the soft-toned nose part 32 is a communicating hole 322; an upper valve 51 and a lower valve 52 that are combined by means of said communicating hole 322, the neighboring sides of each valves are jointly tightened and clamped to the surrounding of said communicating hole 322, to have an anti-leak function, wherein one valve has a valve plate 53 that opens one-way to the outside, so the mask will have a water drain effect when the diver is breathing out. On the side of the lower valve 52 neighboring the nose part is the formation of slightly-protruding protrusion ring 521 that can be clamped tightly with the nose bottom part 321, to have an anti-leak effect. A joining plate 6 with a communicating hole 61, located at the bottom side of the nose bottom part 321, so said pair of valves pass through the communicating hole 61 to be combined; on the bottom side of said joining plate 6 and nearer to its circumference is the formation of a protruding rail 62. A nose bridge rack 8 that is resting against the protruded nose bridge part 323, to be combined as one unit, a valve protecting cover 7 in the shape of a depressed plate, one end of the protective cover 7 is without a side wall 72, to form a rear end opening 71 facing the nose bottom part, and on the side wall can be the formation of depressed groove 73, said depressed groove is combined with the edge of the joining plate, to the valve protecting cover is installed on the lower part on the outside of the joining plate, to protect the valve plate and the water drain guide, in the aforementioned construction, the inventor has found that it requires several components to solve a same problem, such as, for the valve reinforcing and joining effect, one component is disassembled into two components, because there will be a clearance between a single valve and a soft-tone hole, it is not easily assembled, so it adopts a tightening structure, but still, there is a clearance between the valve cover and the hole of the nose part, therefore, it has an additional joining plate, and another protective cover to guide the water flow, thus, the production and assembly of the entire construction become complicated, involving many components, inconvenient application, inconvenient management, and increased production costs, to solve the above problem, the inventor has developed and designed a "structural improvement of water drain groove for diver mask".

SUMMARY OF THE INVENTION

The primary objective of the present invention is to present a "structural improvement of water drain groove for diver mask", with better joining effect, to allow monoblock forming of the water drain groove structure with a hole on the mask, to reduce assembling time required, and ensure that there will be no clearance between the water drain groove and the mask.

To achieve the above objective, the construction of this invention involves a mirror-frame shaped face mask, inside the mask is a soft-toned inside flange, at the middle of the lower half of the inside flange is a nose part, at the bottom side of said nose part is a hole, to the hole is connected a water drain unit, characterized in that: the rim of said water drain unit is buried to the hole of the nose part, said water drain unit having a connecting frame part, the connecting frame part protruding outward, on the bottom side of the nose part is the formation of a ring part that protrude to the outside to guide the water and prevent water from flowing in, and, spaced at the middle of the ring-shaped connecting frame part are a number of through holes, to enable the joining of the bottom side hole of the nose part with the connecting frame part as one unit, at the middle of the water drain unit is a fixing hole, the fixing hole is connected by a number of connecting strips to the connecting frame part, the outside of each connecting strip is pressed a membrane, the center of the membrane is fixed in the fixing hole, so the membrane covers the communicating hole between the ring part of the nose part and the water drain unit.

To enable further understanding of the integral construction, installation, characteristics and performance of the present invention, the preferred embodiment of the present invention is described in details accompanied by drawings below:

DETAILED DESCRIPTION OF PREFERRED EMBODIMENT

Figure 1:
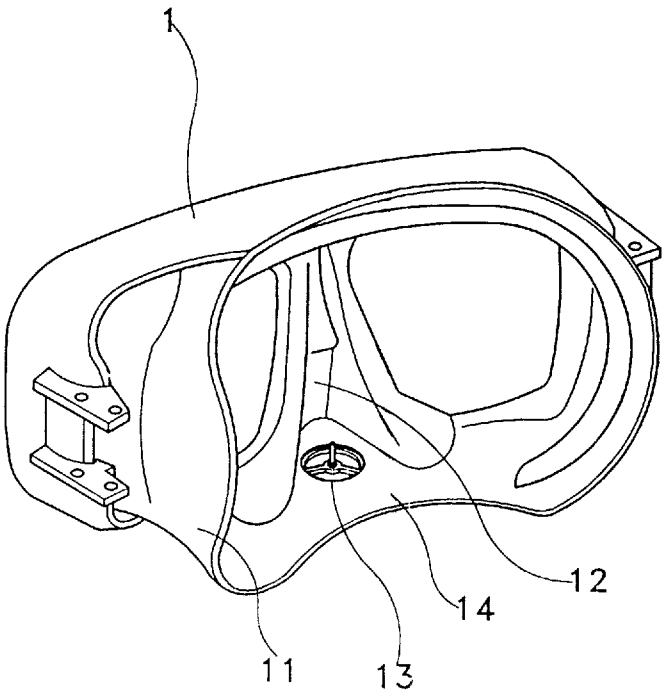
FIG. 1 is a perspective view of the invention.
Figure 2:
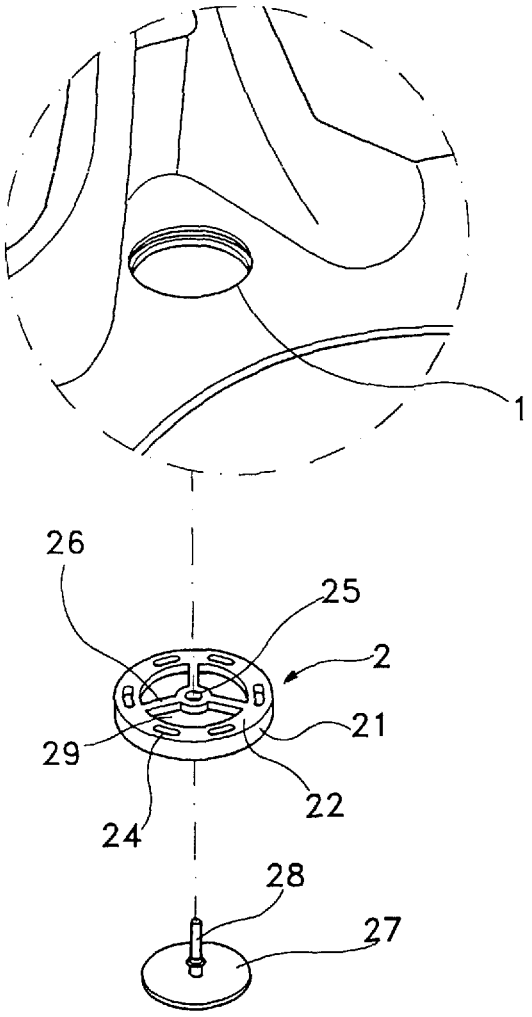
FIG. 2 is an exploded view of the invention.
Figure 3:
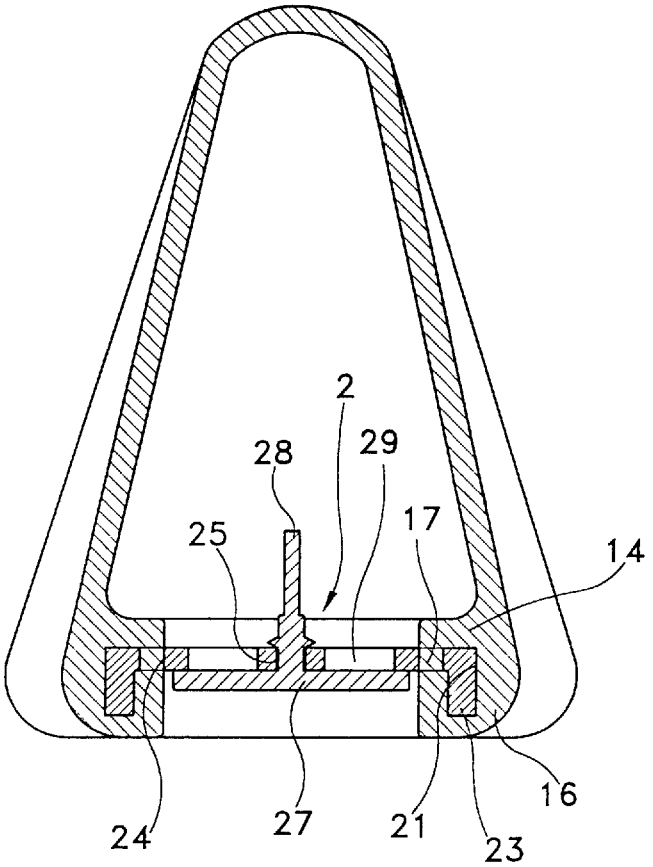
FIG. 3 is a sectional assembled view of the invention.
Figure 4:
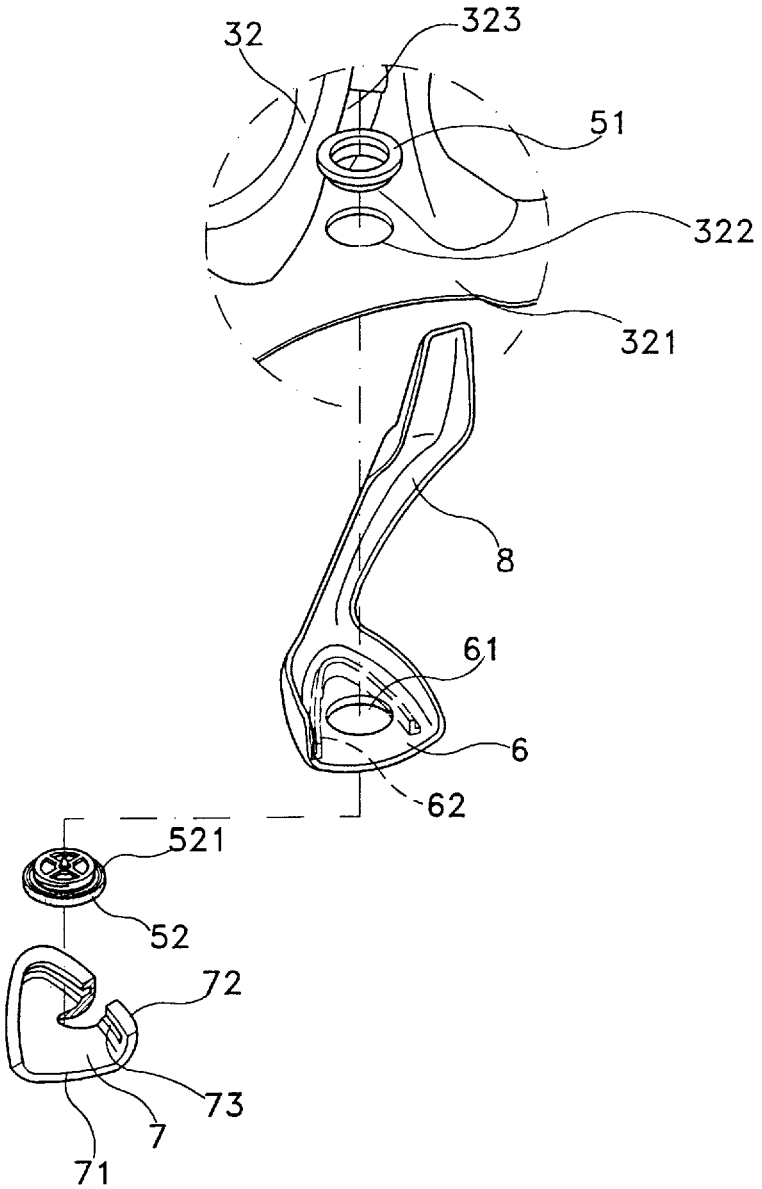
FIG. 4 (PRIOR ART)
FIG. 4 is an exploded view of a prior art.
Figure 5:
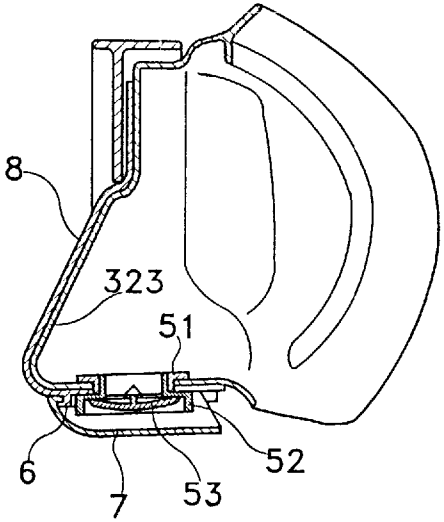
FIG. 5 (PRIOR ART)
FIG. 5 is a sectional assembled view of a prior art.

As illustrated in FIGS. 1 through 3, this invention relates to a "structural improvement of water drain groove in a diver mask". This invention of diver mask involves a mirror-frame shaped face mask 1, inside the face mask 1 is a soft-toned inside flange 11, at the middle of the lower half of the inside flange 11 is a nose part 12, at the bottom side of said nose part 12 is a hole 13, to the hole 13 is connected a water drain unit 2, characterized in that: the rim 21 of said water drain unit 2 is buried at the side of the hole 13 of the nose part 12, and said water drain unit 2 has a connecting frame part 22, the connecting frame part 22 being formed on an outer surface of the water drain unit, at the bottom side 14 of the nose part 12 is the monoblock formed formation of outward ring parts, 23,16 which serve to guide the water and act as a seal to prevent water leakage, at the middle of the ring-shaped connecting frame part 22 are a number of through holes 24, to enable the side of the hole at the bottom side of the soft-toned nose pair 12 to run through the through hole 24 by means of the fixing connecting part 17 to join with the connecting frame part 22 as one unit, at the middle of the water drain unit 2 is a fixing hole 25, the fixing hole 25 is connected to the connecting frame part 22 with a number of connecting strips 26, to the outside of each connecting strip is pressed a membrane 27, the fixing strip

28 at the center of the membrane 27 is fixed to the fixing hole 25, so the membrane 25 covers the communicating hole 29 between the ring part 16 of the nose part 12 and the water drain unit 2, since the location of the membrane 25 is lower than the ring part 16, the membrane 27 will not be subjected to the impact of water flow and opened.

As mentioned above, the main performance of this invention is that: with the fixing mechanism that is inserted to form, only one component will be achieve the effect of multiple components as in a prior art, besides providing the water drain function of the membrane, the nose part has a partially projected structure, to enable a water flow guiding function, without having to install a protective hood as in a prior art, besides, there is no clearance between the water drain unit and the hole of the nose part, this is the major difference between this invention and a prior art so there shall be no occurrence whatsoever of water seepage between the water drain unit and the hole, therefore, this invention will reduce the costs in assembling and manufacturing processes, meanwhile, a user will find it easy to use, the water draining function becomes easier, and the manufacturer will find it more convenient to produce.

The above description covers only the preferred embodiment of this invention, which shall not be based to limit or restrict this invention, and that all equivalent variations easily conceivable to whoever skilled in the art will be included in the intent and range of the subject invention.

I claim:

1. A water drain groove for diver mask, the diver mask involving a mirror-frame face mask, the mask having a soft-toned inside flange, a nose part positioned at the middle of the lower half of the inside flange, a hole formed at a bottom side of the nose part, a water drain unit joined to the hole: a rim of the water drain unit is buried in the hole of the nose part, the water drain unit having a connecting frame part, the connecting frame part forming an outer surface, and an outwardly protruding ring part formed on the bottom side of the nose part being the formation of a outwardly protruding ring part which serves to guide the water and act as a seal from water leakage, and a number of through holes spaced between the middle of the ring-shaped connecting frame part, so the hole at the bottom side of the soft-toned nose part is joined with the connecting frame part as one unit by connecting of the through holes, a fixing hole positioned at the center of the water drain unit being a fixing hole, the connected by a number of connecting strips with the connecting frame part, a membrane pressed to the outside of each connecting strip, the center of the membrane being fixed into the fixing hole, the membrane covers the communicating hole between the ring part of the nose part and the water drain unit.

* * * * *